United States Patent [19]

Brownbill et al.

[11] Patent Number: 4,765,265

[45] Date of Patent: Aug. 23, 1988

[54] APPLIQUE MACHINES

[75] Inventors: Thomas D. Brownbill, Dartmouth, United Kingdom; Harald Koenig, Lustmuhle, Switzerland

[73] Assignee: Jakob Schlaepfer & Co., AG., Switzerland

[21] Appl. No.: 907,504

[22] Filed: Sep. 15, 1986

[30] Foreign Application Priority Data

Sep. 13, 1985 [GB] United Kingdom ..... 8522738
Jun. 13, 1986 [GB] United Kingdom ..... 8614489

[51] Int. Cl.[4] ..... D05C 3/02; D05C 7/08

[52] U.S. Cl. ..... 112/88; 112/90; 112/99

[58] Field of Search ..... 112/88, 84, 86, 90, 112/103, 99, 100, 101

[56] References Cited

U.S. PATENT DOCUMENTS 1,510,378 9/1924 Bolandi ..... 112/99
1,548,837 8/1925 Groebli ..... 112/99
1,550,778 8/1925 Bretschneider ..... 112/88
2,699,749 1/1955 Smith ..... 112/100
3,390,650 7/1968 Ochsner ..... 112/88
4,364,244 12/1982 Vambutas et al. ..... 66/75.2
4,594,952 6/1986 Comploi et al. ..... 112/84

*Primary Examiner*—H. Hampton Hunter
*Attorney, Agent, or Firm*—Ostrolenk, Faber, Gerb & Soffen

[57] ABSTRACT

An embroidery and applique machine having a number of article feeding modules, each adapted to supply articles such as sequins which are to be appliqued in alignment with a needle. The feeder modules are mounted on a carriage for movement therewith. A motor moves the carriage back and forth along a fixed path relative to the needles. An indexing mechanism is effective for stopping the carriage at any one of a number of positions in which the feeder modules are in register with the needles for supplying articles in alignment with a particular needle. A number of carriages may be provided at positions relative to the needles. A lost motion flange on the carriage contacts abutments on the indexing mechanism and enables the feeder modules on the carriage to register with the needles irrespective of the direction of movement of the carriage on the path.

12 Claims, 4 Drawing Sheets

APPLIQUE MACHINES

BACKGROUND OF THE INVENTION

This invention relates to applique machines and has particular reference to machines for applying or appliquing decorative articles to a material, either separately or in combination with an embroidering and/or stitching action.

One particular group of machines for embroidery work generally comprises a frame supporting an area of material or fabric to be embroided or decorated in a plane, a needle support bar supporting a row of regularly spaced needles along the bar, each needle comprising an assembly capable of effecting a stitching operation in a plane substantially perpendicular to the plane of the material or fabric to be decorated, means for enabling a selected number of said needles to make a stitch in said material, means for moving the material or fabric relative to the needle bar to obtain a desired stitching or embroidery pattern and control means controlling said moving means and enabling and disenabling selected needles in order to obtain a desired stitch pattern.

Needles in such a machine may be enabled or disenabled by simply mounting or removing the needles as the case may be. In more modern machines, needles are enabled and disenabled under electronic control.

Machines of this general type are well known and have been in use in the textile industry for many years. In the embroidery or decoration of large amounts of fabric, a typical machine may have a length of fabric supported in a frame some 10, 15 or 20 yards long and the bank of needles extending across the frame may include as many as 100 or more needles typically 680, 1020 or 1360 respectively given the smallest repeat of pattern. In order to obtain changes of color and/or repeat in such machines, the changes may be effected as follows:

A change of repeat means the withdrawal of every second, second and third, second, third and fourth needle and so on, leaving needles 1—3—5, or 1—4—7, or 1—5—9 in operation. This can be done manually or mechanically, normally leaving only one color of threads in the needles.

A change of colors requires two or three (or any number of) needles side by side, threaded with the same sequence of colors. This means, however, that in the smallest repeat only one color is available, that the use of two colors requires duplication of the repeat, and three colours will push the repeat up to the use of every fourth needle only. However, technically bigger repeats may very well be threaded like this: Needles 1,2,3—5,6-,7—9,10,11 etc. to be repeated over the length of the machine. Selection of needles 1—5—9, or 2—6—10 will correspondingly change the color used within the given repeat.

Means for selectively enabling and disenabling needles is very well known and reference in this connection is made to U.S. Pat. No. 3,709,172 and U.S. Pat. No. 3,872,812 as being typical of many examples in this field.

In more recent years there has been a demand for decorative materials of a different nature in which articles are applied and stitched to the fabric.

Applique work such as this has also been effected on machines of the type described above, such machines generally being modified by the provision of a plurality of feeder module devices for supplying articles sequentially to each needle position when required and aligning each article with a needle axis to enable the appliquing step to take place. See, for example, British Patent Specification No. 1093300 and U.S. Pat. No. 1,107,593.

The prior art has, therefore, been very much concerned with the provision firstly of color changes in the embroidery and secondly, the supply of articles, such, for example, as sequins to be applied to the fabric either as a sole decoration or in addition to embroidery. Applique machinery comprises as described above, a large number of needles with a feeder device firmly and fixedly associated with each needle position thus making color changes, apart from manual changes of thread through several hundred needles, virtually impossible. The feeder devices are firmly screwed to the machine in opposition to the needles, while the tine-wheels were mounted on an axle stretching over the length of the machine. Machines of this type, therefore, will hereinafter be referred to as "machines of the kind described".

The disadvantages of these prior art machines are that the presence of the feeder module array in close juxtaposition to the needle (usually over the top) means that access to the needles themeselves is restricted and that observation of the needle performance is also restricted.

Any change in color of the articles being supplied by a feeder module is difficult and time consuming to effect. The changeover involves removal of the existing supply tape of articles and substitution with a supply tape of different color or different nature of article.

Thus, effectively, such machines are limited to one color combination with a given needle only and it makes multi-colors applique work very slow, and even if if there is a sufficient combination of colors with needle threads across the bank of needles, the production of a pattern with a plurality of differently colored appliqueing material is still very slow and results in multiple changes of the decorative material with respect to the needle bank between stitching operations.

With increasing sophistication of the clothing market there is an increasing demand for machines which can provide multi-color embroidery work and at the same time multi-colors applique work with different colours of articles to be appliqued being supplied to each selected needle position.

SUMMARY OF THE INVENTION

According to the present invention, there is provided an embroidery and applique machine of the kind described characterized by (i) carriage means capable of sliding movement with respect to said needle bar, said carriage means supporting said feeder modules for movement therewith;

(ii) motor means for moving said carriage; and (iii) indexing means for controlling the movement of said carriage between any selected one of a number of positions in which modules are in register with a corresponding needle for the supply of an article in alignment therewith whereby movement of the carriage by said motor means in combination with said indexing means permits different feeder modules to register with a given needle, thereby permitting one of a number of different articles or colors to be supplied to any given needle position.

The control and indexing means may selectively operate individual feeder modules only or may operate selected groups of feeder modules, in register with the selection made regarding needle distance and/or needle color. The individual addressability of the modules, combined with their sliding movement, provides for a repeat *and* color change within the appliqueing material.

In one embodiment of the invention the carriage means comprises a longitudinal sleeve supportably mounted on a support rod. In a particular embodiment of the invention, a pair of support rods are provided in spaced parallel relationship and the carriage means comprises a pair of sleeves slidably mounted one on each rod and a fixed band of feeder modules carried thereby. The motor means may be a ram and the indexing means may comprise a plurality of fixed solenoids each of which has an armature core movable between an engaging and a retracted position, and a detent means on the carriage. Whereby on activation of any given solenoid to move the core to the engaging position, actuation of the ram causes or allows movement of the carriage so that the detent means engages said core of said solenoid to align the feeder modules carried by said carriage in register with any of a selection of needle positions for applique operations. The ram may be a pneumatically driven double acting ram capable of positively driving said carriage in either direction and the detent means on the carriage may be capable of limited lost motion relative to said carriage whereby registration of the feeder modules with the needle is obtained irrespective of the direction of engagement of the detent means with any given solenoid core.

The extremities of carriage movement may be defined by fixed stops and the number of solenoids may be the number of possible carriage positions less two. In a particular embodiment of the present invention, the number of possible carriage positions is five and the number of solenoids is three.

The detent means may be carried on the ram rod and may comprise a sleeve having a flange defining first and second abutment surfaces, said sleeve being slidably mounted on a rod carried by carriage for movement between a pair of spaced stops. In a further embodiment of the invention the air supply to the ram may be maintained throughout the appliquing operation in order to maintain the carriage in positive location with the indexing means throughout the appliquing and stitiching operation.

In one embodiment of the invention, the feeder modules may be fixedly secured to the carriage. In an alternative embodiment, the feeder modules may each comprise a substantially self-contained module having means for releasably attaching each feeder module to said carriage in an operative position said attachment means include electrical connection means for operation of electrical components with said module.

The invention further includes a feeder module for use in the apparatus in accordance with the present invention, said module comprising:

(i) a tape path for guiding a longitudinal tape having a longitudinal sequence of articles to be stitched, and
(ii) tape advancing means for advancing said tape, along said tape path by integer motion in timed relation to the stitching operation, to present the articles successively at said stitching station with their holes aligned with the needle axis preparatory to commencement of successive stitching operations.

Preferably, the feeder module comprises means engageable directly with the tape to lock the articles stationary relative to the needle axis while they are being stitched.

The device may comprise means engageable directly with the tape to lock the articles stationary relative to the needle axis while they are being stitched. Such tape engaging means may be a pin member engageable with the holes in the articles and mounted for movement towards and away from the tape, and means for moving the pin member towards and away from the tape. Advantageously, the tape engaging means may be operated by the tape advancing means.

The tape advancing means in one aspect of the invention may comprise a tined wheel having radially extending tines for engagement with the holes in the articles or in the tape carrying the articles, a pawl wheel drivingly connected to the tined wheel and having teeth engageable by a reciprocatable pawl, and means for reciprocating the pawl to rotate the pawl wheel. It is preferred to include means to prevent reverse movement of the tined wheel while the pawl is moved to engage with a subsequent tooth on the pawl wheel. The reciprocating means may comprise an electromagnet or solenoid and/or a pivotably mounted member to which the pawl is attached, the member being movable (for example, by the electromagnet) back and forth about its mounting to engage the pawl with successive teeth on the pawl wheel.

Alternatively, the tape advancing means may comprise a driving member engageable with holes in the articles on the tape, and means for engaging the driving member with a said hole, advancing the driving member thereby to advance the tape, then disengaging the driving member and causing reverse movement of the driving member. The device preferably further comprises means to resist reverse movement of the tape during reverse movement of the driving member.

The device may further comprise a tape sensor for monitoring the condition of the tape at a tape sensing station. Such a sensor may comprise an abutment member for engagement with the tape, means for biassing the abutment member against the tape, and means responsive to movement of the abutment member, the movement responsive means being arranged to provide an indication when a break or tear in the tape in the region of the tape sensing station allows movement of the abutment member under action of the biassing means.

In the case where the tape is formed by the sequence of the articles joined together at adjacent edges such, for example, as a sequin tape, the apparatus will typically have means to sever the article from the remainder of the tape at the stitiching station. Such severing means may be actuated independently of the stitching action of the needle, but may preferably be provided by a needle member, of which the needle forms part, acting to sever the article during movement of the needle along the needle axis toward the tape.

Following is a description by way of example only and with reference to the accompanying drawings of methods of carrying the invention into effect.

DETAILED DESCRIPTION OF PREFERRED EMBODIMENTS

Figure 1:
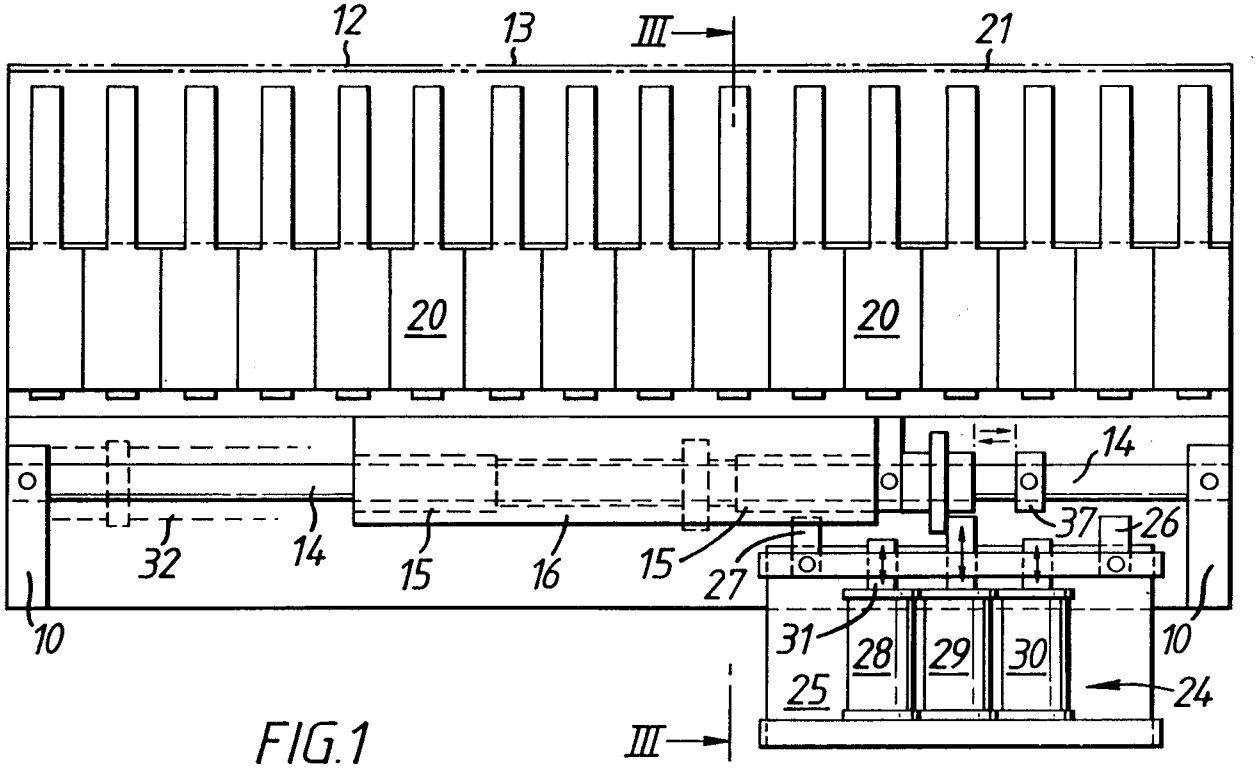
FIG. 1 is a plan view of a feeder module array and indexing assembly for an embroidery or applique machine in accordance with the present invention.

The machine comprises an erect support frame members 10 having extending therebetween a substantially horizontal support frame supporting a plurality (in the embodiment illustrated, sixteen) of needle assemblies in spaced relationship between the frames 10, the needle axis 11 (see FIG. 3) being regularly spaced along the needle support bar (not shown). The erect frames 10 are in spaced relationship with the plane 12 of the fabric which is to be decorated. The fabric 13 is maintained in plane 12 by being supported in a frame (not shown) which is capable of movement with respect to the needle axis in order to enable the desired stiching pattern to be applied.

The frames 10 further support a pair of vertically spaced cylindrical rods 14 of hardened steel bolted and fixedly secured thereto.

Each rod 14 carries a pair of spaced sleeves 15 each of which is secured to a carriage body 16, the sleeves 15 being capable of axial sliding movement along the hardened steel rods 14. The carriage body 16 carries a substantially horizontally disposed module mounting plate 17 fixedly secured to carriage body 16 incorporating sleeves 15. Module mounting plate 17 carries a plurality (in this embodiment, sixteen) of feeder modules 20 as hereinafter described.

Figure 3:
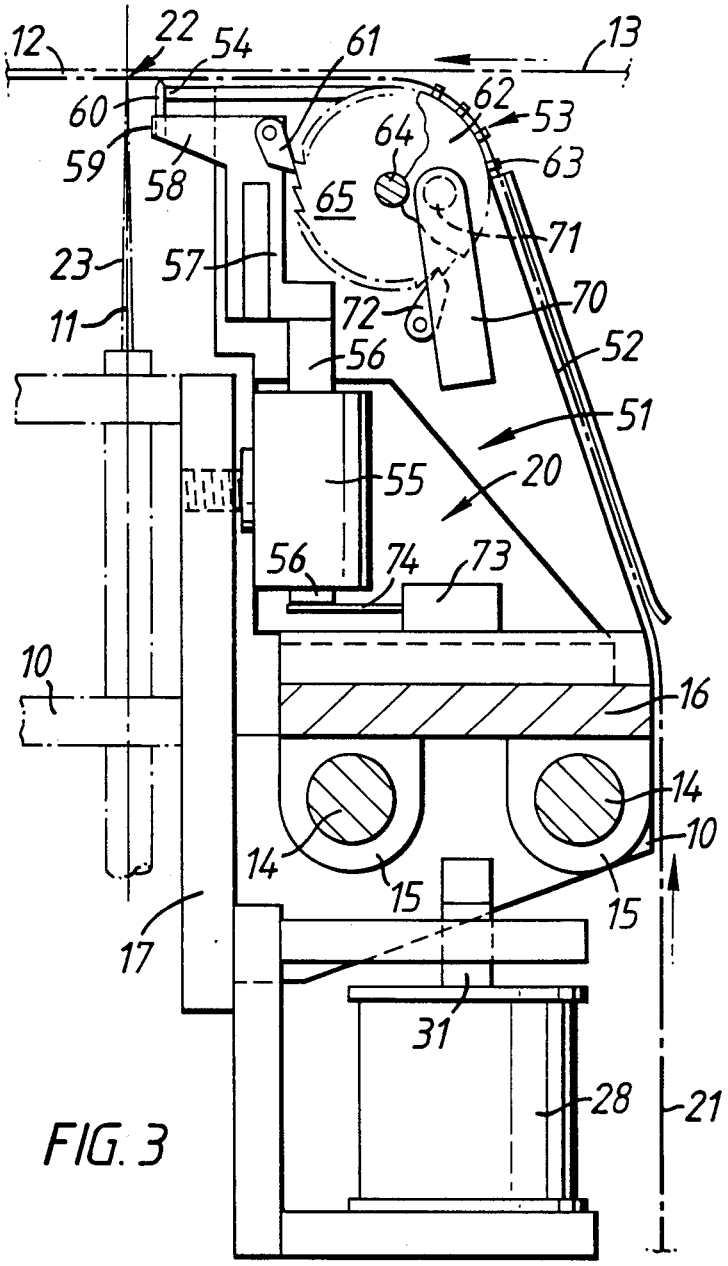
FIG. 3 is a section on the line III—III of FIG. 1.

As seen from FIG. 3 each feeder module is adapted to supply a sequin strip 21 comprising a plurality of sequins joined edge to edge to comprise a sequin strip, to a stitching station indicated generally at 22 with a hole in the sequin presented at said stitching station in register with the needle axis 11 of a needle 23 in juxtaposition to module 20. The needles 23 are fixed with respect to frame 10 whereas the modules 20 are carried by the carriage body 16 which is slidable with respect to fixed rods 14 and hence movable laterally with respect to the fixed needle axes.

On the side of the erect frame 10 remote from the fabric plane 12, there is provided an indexing mechanism 24 comprising a base plate and support frame 25 fixedly secured with respect to frame 10 (see FIG. 1). Indexing mechanism support frame 25 has along its edge juxtaposed to rods 14, a pair of spaced abutment members 26 and 27, and further supports three solenoids 28, 29 and 30, each having an armature core 31 movable between a retracted position and an extended position, the arrangement being such that the diameter of each abutment 26 and 27 and each core 31 of solenoids 28, 29 and 30 are of the same diameter and further such that the axes are equally spaced to correspond precisely with the spacing between adjacent needles on the needle frame, thus providing five abutment stops for control of the movement of the carriage 16.

The carriage 16 is driven by means of a pneumatic ram 32 which is supportd on one of frames 10 by means of inter-engaging trunnions 33 and 34 which are secured one with respect to the other by means of a securing pin 35. The ram 32 is provided at its other end with a ram rod 36 having at its extremity, an annular stop 37 and carrying intermediate its length, an arm 38 which is fixedly secured to ram rod 36 by means of pin 39 and fixedly secured to carriage body 16 as shown diagrammatically in FIG. 2, thus permitting movement of the ram rod 36 to be transmitted to carriage body 16. The portion 36' of the ram rod 36 disposed between annular stop 37 and arm 38 carries a sleeve 40 having a central flange 41 defining first and second annular abutment surfaces 42 and 43 respectively. The sleeve 40 is capable of sliding between a position in which its first end face 44 abuts the adjacent surface of arm 38 and a second position in which the second sleeve end face 45 abuts the adjacent annular surface of annular stop 37.

In operation, with all the solenoids 28, 29 and 30 disenabled so that the core 31 of each of said solenoids is in a withdrawn position, actuation of the ram to extend the ram rod 36 results in the ram rod and correspondingly the carriage 16 moving until the second abutment surface 43 of annular flange 41 engages with the extremity of first abutment member 26. The lost motion of the sleeve 40 permits continued movement of the ram rod until the sleeve first end face 44 is in abutment with the corresponding surface of arm 38. In this position the carriage will be at the extremity of its travel and modules 20 will be in alignment with corresponding needles 23 to allow a stitching operation by some at least of needles 23 to effect stitching of a sequin presented at stitching station 22 to the fabric 13.

Throughout the stitching operation air is supplied under pressure to the ram to maintain the ram in firm abutting relationship with the end stop 26 through the mechanism of the lost motion sleeve 40 to ensure accurate registration of needle 23 with a sequin presented at the stitching station 22 by means of a module 20 on the carriage.

Figure 2:
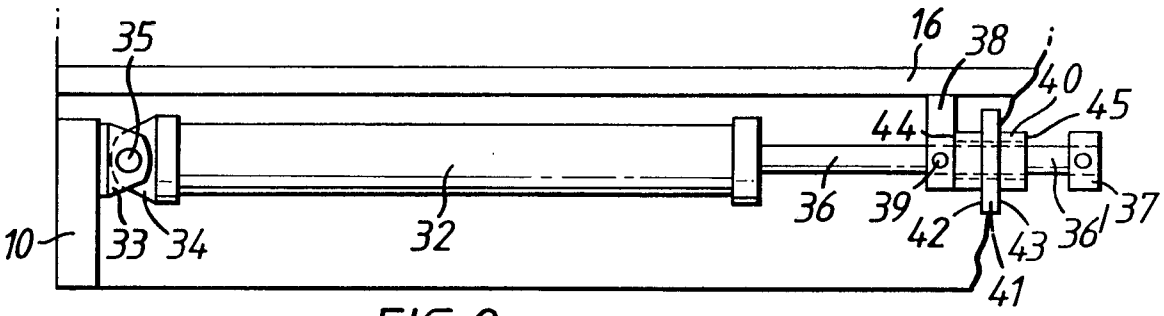
FIG. 2 is a detail of the ram assembly of FIG. 1.

Release of the pressure in the ram 32 and the application of pressure to withdraw the ram leftwards with respect to FIGS. 1 and 2 will result in disengagement of flange 41 from member 26 until continued movement of the ram brings the first abutment surface 42 of central flange 41 into engagement with second abutment member 27. Continual withdrawal of the ram result in further movement of the ram rod 36 with respect to the sleeve 40 now held stationary by second abutment member 27 until the annular stop 37 engages the sleeve second end face to prevent further leftward movement of the ram thus producing movement of the carriage corresponding to five module places with respect to the needle bank thus permitting a second type or color to be brought into registration with the needles. Registration is ensured because the lost motion of the sleeve 40 corresponds precisely to the diameter of the abutments 26 and 27. Intermediate positions between the one and five position, namely the two, three and four positions for the modules may be effected by activating one of the solenoids 28, 29 or 30 to extend its core as shown by coil 29 in FIG. 1 to engage with the flange 41 thus producing alignment of the third or middle module within the group for operation in combination with a given needle. The lost motion sleeve 40 provides the means of positive location of the module with the needle axis irrespective of the direction of throw of the ram. If the ram is moving rightwards as shown in FIG. 1 then the contact between the core 31 of coil or solenoid 29 will be between the second abutment surface 43 of the flange 41 via the first end face 44 and the arm 38 whereas with leftward movement of the ram rod 36 the abutment will be on the other side of core or armature 31 of coil 29 between the first abutment surface 42 of the central flange 41 via the second end face of sleeve 40 and the annual stop 37.

The carriage components are preferably formed of duraluminium in order to reduce the kinetic energy of movement of the carriage to a minimum.

Turning now to the feeder module 20, this comprises a housing 51 formed of an injection molded material such, for example, as glass filled nylon having in an exterior surface a tape path 52 extending about a tape drive 53 to a dispensing and indexing area 54. The housing 51 accommodates an the side thereof adjacent module mounting plate 17, a coil 55 having a central armature 56 which is offset at 57, towards the needle axis, which latter part 57 carries at its distal end a further offset portion 58 extending from the axis of armature 56 towards needle axis 11. The extremity 59 of further offset portion 58 carries a pin 60, the axis of which is in spaced parallel relationship with the needle axis 11 which is adapted to extend into the tape path 52 to engage with the central hole of a sequin in the sequin tape passing along path 52 to held the penultimate sequin on the tape relative to module 20 thus aligning the end sequin hole with axis 11 of needle 23.

The inner extremity of further offset portion 58 is provided with a pawl 61 while the armature 56 is spring loaded to a datum position with the pin 60 extending into tape path 52 in its engaging position.

Housing 51 carries a tined wheel 62 having a plurality of tins 63 adapted to engage with the central hole of each sequin whereby movement of tined wheel 63 will produce corresponding arcuate movement of the sequin tape along the tape path 52 where the tines 63 interact with said path. Tined wheel 62 is journalled for rotation about an axial 64 which also carries for rotation with the tined wheel with a ratchet wheel 65 for engagement with pawl 61, pawl 61 being spring loaded (not shown) into engagement with the ratchets on wheel 65.

The housing further includes a spring strip 70 secured to one surface of the housing 51 and carrying at its outer extremity a friction pad 71 adapted to bear against the side face of either tined wheel 63 or ratchet wheel 65 to damp the motion of the wheel on operation of the solenoid 55. A second pawl member 72 is spring loaded into engagement with ratchet wheel 65 to prevent any movement of tined wheel 62 tending to reverse the movement of tape along tape path 52.

Figure 4:
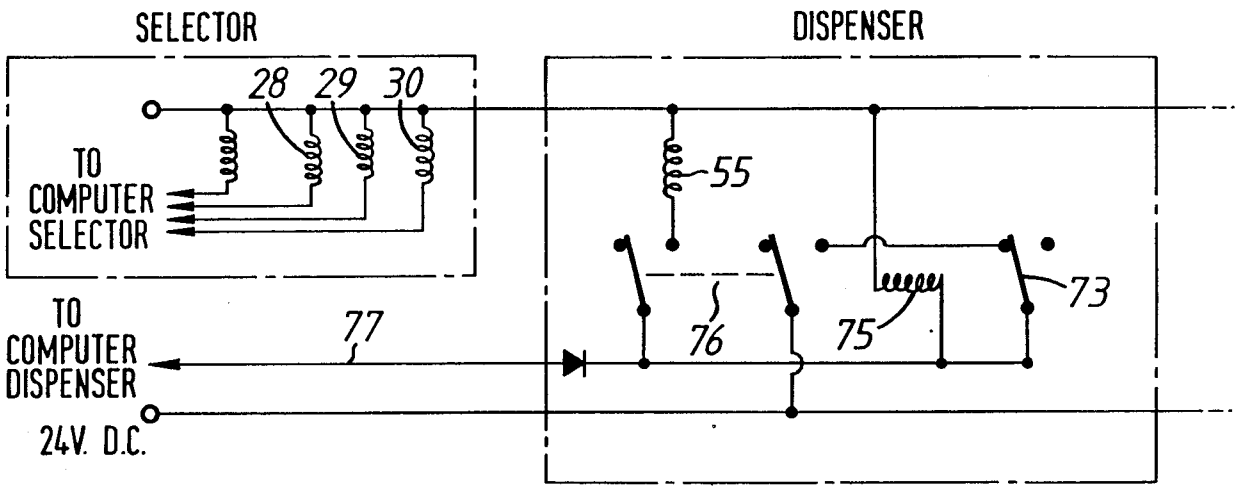
FIG. 4 is a diagram of the control circuit for operation of the feeder module of FIG. 3.

The lower portion of the housing accommodates a microswitch 73 having an actuating arm 74 adapted to engage with the lower extremity of armature 56 of solenoid 55. The control circuit of the device is shown in FIG. 4. The coil or solenoid 55 is connected in the circuit by means of a relay 75 which operates double pole switch 76. In the datum position, the solenoid armature 56 is spring loaded to a position in which the pin 60 in engaged with the hole of the penultimate sequin within the strip presenting and maintaining the end sequin with its hole aligned with a needle axis. In this position the armature 56 is forward and the arm 74 of microswitch 73 is in a position such that microswitch 73 is made as shown in FIG. 4.

A computer pulse transmitted along computer bus 77 triggers relay 75 to make dipole 76, latching in the relay and at the same time energizing coil 55. The energizing of coil 55 results in retraction of armature 56 against its spring loading to withdraw pin 60 from the sequin hole in the sequin path so that after the extremity of pin 60 has moved out of the sequin path 52, pawl 61 engages a ratchet on ratchet wheel 65 to advance tine wheel 62 by one ratchet to an extent to present the next sequin for engagement with pin 60. Continued withdrawal of armature 56 results in the lower extremity of armature 56 engaging microswitch arm 74 thereby tripping microswitch 73 to deenergize the relay and allow the dipole to open thus removing current supply to coil 55 whereby the armature 56 is extended from solenoid 55 in an upward direction under its spring loading until pin 60 engages the penultimate sequin in the strip once more and the sequin advance cycle is thus completed.

It will be appreciated from the foregoing, therefore, that it will be possible to position any one of five modules 20 in register with any given needle. Thus, by grouping needles in groups of five with five different colors of thread in combination with a group of five modules 20 each dispensing a different color of sequin, any permutation or combination of the five colors of thread with the five colors of sequin may be achieved simply by the application of the necessary digital signal (a) to enable or disenable a needle or needles, (b) to trigger operation of ram 32 and solenoids 28, 29 and 30 to move the carriage to produce the desired combination of sequin color and thread, and (c) to trigger advance or operation of all or the appropriate module to present a sequin at a given needle preparatory for a stitching operation.

This improvement constitutes a considerable advance in the art. Furthermore, the modules may be arranged to be plugged into the carriage so that where further color changes are necessary, change of the magazine modules is easily effected without the need to "thread up" a new module. The existing module is simply unplugged and removed with its reel of sequins and a new module with its associated reel of different colored sequins is plugged into the carriage.

Furthermore, the injection molded nature of the feeder module results in a lighter construction, it is cheap to reproduce and in the event of damage, the existing module is simply removed and replaced by an exactly similar module.

What is claimed is:

1. An embroidery and applique machine, comprising:

a frame and a plurality of needles extending spacedly along and supported by the frame and in position to operate on a fabric;

a plurality of article feeders for supplying to the needles articles which are to be fastened by the needles to the fabric, and an article feeder support for supporting the article feeders; and moving means for moving the article feeder support relative to the needles in a manner that enables different ones of the article feeders to be aligned to different ones of said needles.

2. A machine as in claim 1, including a needle bar and the needles being supported on the needle bar, the article feeder support including a carriage, the moving means including motor means for moving the carriage, and further including indexing means for controlling movement of the carriage such that the carriage is capable of being stopped at any selected one of a predetermined number of stop positions in which the article feeders are in register with corresponding needles.

3. A machine as in claim 2, wherein the moving means further includes a support rod, a longitudinal sleeve slidably mounted on the support rod, and coupling means for coupling the carriage to the sleeve.

4. A machine as in claim 12, wherein the motor means comprises a ram.

5. A machine as in claim 2, wherein the indexing means comprises a plurality of fixed solenoids, each solenoid having a core movable between an engaging position and a datum position, and including a flange movable with the carriage and positioned to engage any one of the cores which is in its engaging position, whereby actuation of the moving means causes movement of the carriage effective to allow the flange to engage that one of the cores which is in its engaging position to enable alignment of the article feeders relative to the needles.

6. A machine as in claim 5, wherein the motor means includes a ram having a movable ram rod, the ram rod being movable along first and second opposite directions, the moving means including a support rod, a longitudinal sleeve slidably mounted on the support rod, the flange being coupled to the longitudinal sleeve, the longitudinal sleeve being capable of providing limited lost motion relative to the support rod whereby registration of the article feeders with the needles is obtained irrespective of the direction of engagement of the flange with any given solenoid core.

7. A machine as in claim 5, including first and second fixed end stops, the cores of the solenoids being positioned between the end stops.

8. A machine as in claim 7, comprising three of the solenoids in addition to the first and second end stops whereby each one of substantially all of the article feeders is capable of being located in registration with a respective group of five needles.

9. A machine as in claim 5, wherein the flange defines first and second abutment surfaces for abutting the cores.

10. A machine as in claim 1, including means for releasably attaching each one of the article feeders to the feeder support.

11. A machine as in claim 10, wherein the releasable attachment means includes electrical connecting means for effecting electrical connections between each article feeder and the machine.

12. A machine as in claim 1, wherein each of the article feeders comprises:

a tape path for guiding a longitudinal tape holding a plurality of articles arranged serially on the tape; and tape advancing means for advancing the tape stepwise and in timed relation to a stitching operation associated with the machine in a manner which enables the articles to be successively presented at a stitching station to be stitched to the fabric by a corresponding one of the needles.

* * * * *